United States Patent [19]

Anderson et al.

[11] 4,027,915

[45] June 7, 1977

[54] SUN SHIELD ASSEMBLY FOR DETACHABLE ATTACHMENT TO INFANT'S SEAT

[76] Inventors: Donald Anderson; Kaye Anderson, both of 17091 Regulus, Yorba Linda, Calif. 92686

[22] Filed: May 7, 1976

[21] Appl. No.: 684,103

[52] U.S. Cl. ..... 297/184

[51] Int. Cl.[2] ..... A47C 7/00

[58] Field of Search ..... 297/184; 135/5 E, 6, 135/7.1 R; 105/329 SC; 248/405 A, 467; 403/354, 375; 5/113, 284, 362; 2/8, 12, 14 D; 296/28 CU

[56] References Cited

UNITED STATES PATENTS

| | | | |
|---|---|---|---|
| 2,385,296 | 9/1945 | Moore | 248/205 A |
| 2,638,593 | 5/1953 | Eloranta | 2/12 |
| 3,008,761 | 11/1961 | McIlvaine | 297/184 X |
| 3,380,073 | 4/1968 | McLaughlin | 2/8 |
| 3,482,809 | 12/1969 | McCall | 248/205 A |
| 3,858,242 | 1/1975 | Gooding | 2/427 X |
| 3,929,372 | 12/1975 | Gesslein | 297/78 A |

*Primary Examiner*—James T. McCall
*Attorney, Agent, or Firm*—Joel Halpern

[57] ABSTRACT

A sun shield assembly for detachable attachment to an infant's seat includes a pair of mounting brackets and a hood mountable in the brackets. Each bracket is formed with a base having an adhesive material on one face thereof and a hollow cylindrical boss projecting from the other face of the boss. The hood is given a pair of cylindrical pivot pins which extend from the opposed side walls of the hood and are dimensioned to pivot within the corresponding boss of the mounting bracket. The hood is made of a material which is sufficiently resilient such that the side walls can be separated to a spaced apart distance whereby the pivot pins can be inserted into the respective bosses.

4 Claims, 4 Drawing Figures

FIG.1
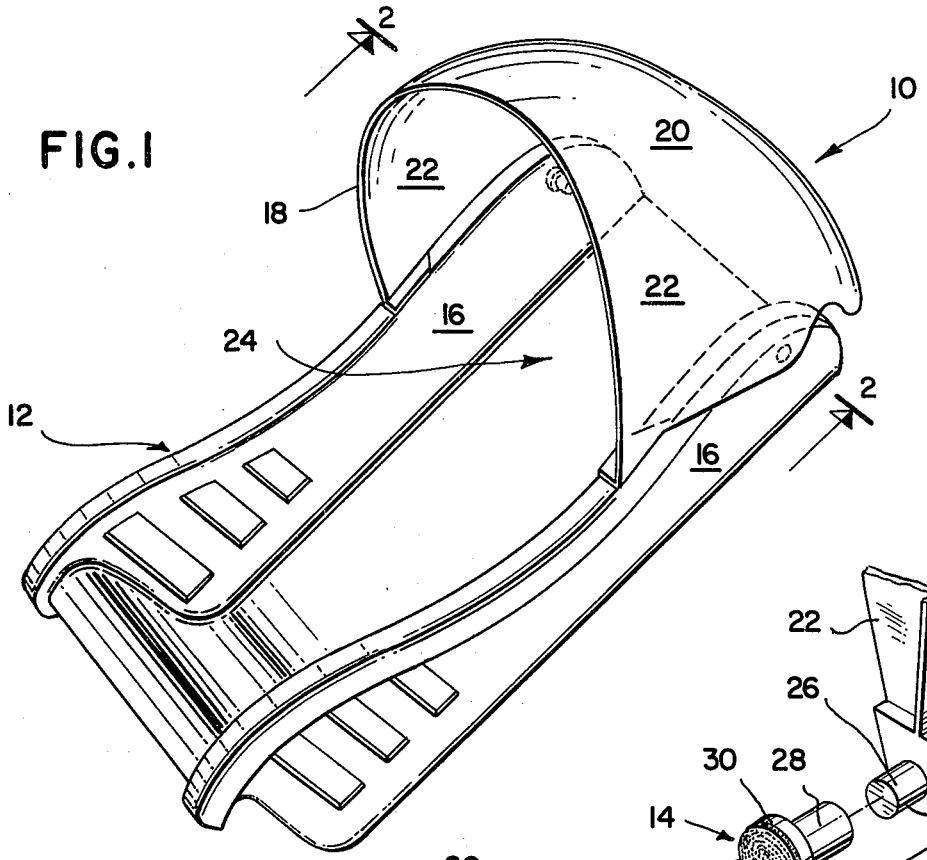
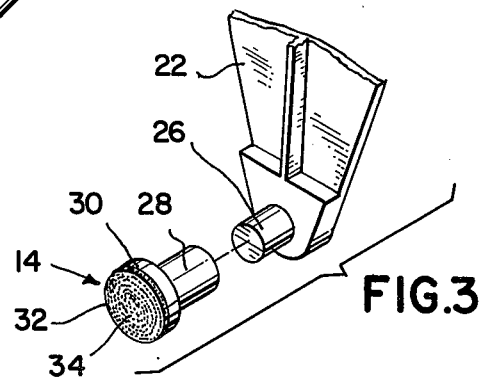
FIG.3
FIG.2
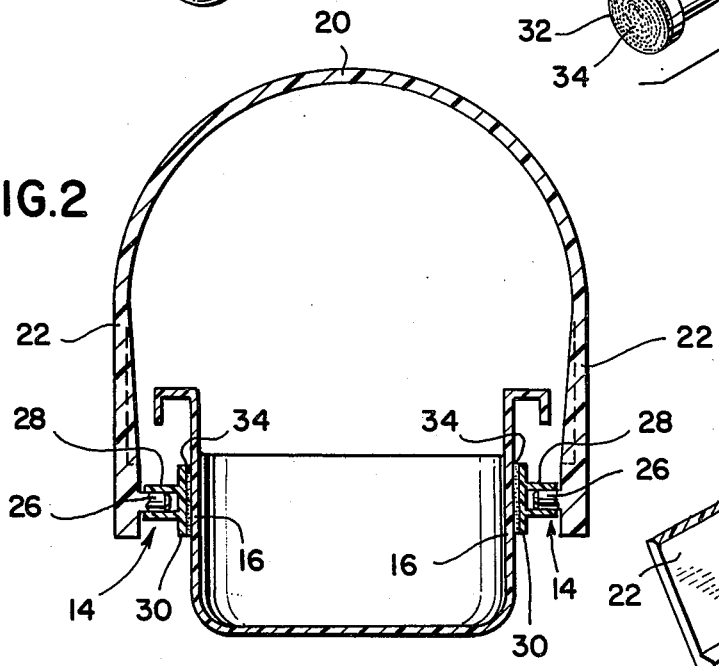
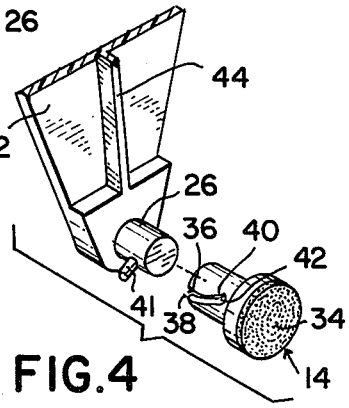
FIG.4

SUN SHIELD ASSEMBLY FOR DETACHABLE ATTACHMENT TO INFANT'S SEAT

BACKGROUND OF THE INVENTION

The present invention relates to sun shields or canopies and more particularly to a sun shield assembly which can be detachably secured to an infant's seat.

Canopies and like devices for carriages, playpens, etc., have been known heretofore and are disclosed, for example, in U.S. Pat. No. 1,289,965 issued Dec. 31, 1918 to E. Tichenor and in U.S. Pat. No. 2,681,659 issued June 22, 1954 to N. M. Hrinsin. Such prior devices, however, required installation of the canopy in a fixed location on the carriage or playpen because of the need to affix same by means of screws, bolts and the like which necessitated that either the aperture or screw or bolt be located on the carriage or playpen at a fixed location. The canopy to be adjustable, required additional structural modification. To store the canopy when not in use it was necessary to resort to hand tools which, for the most part, are not familiar to many mothers. Further, the construction of such canopies and supporting structures were relatively expensive.

SUMMARY OF THE INVENTION

It is one object of the invention to provide a sun shield assembly for detachable attachment to an infant's seat which is simple in construction and connectable without the need for conventional fastening means or the use of any hand tools.

It is another object of the invention to provide a sun shield assembly for detachable attachment to an infant's seat which can easily be adjusted to the desired angular position.

Other objects and advantages of the invention will become readily apparent from the following description of the invention.

According to the present invention there is provided a sun shield assembly for detachable attachment to an infant's seat comprising in combination: a pair of mounting brackets each having a base portion and a hollow cylindrical boss projecting from one face of said base portion, an adhesive material being provided on the opposed face of said base portion for releasably securing the bracket to an infant's seat; and a hood having a top wall and opposed side walls, a pivot pin integral with each of the side walls and projecting laterally therefrom having a configuration complementary to that of the corresponding boss of the mounting bracket and dimensioned to be accommodated rotatably within the bosses, said hood being sufficiently resilient to permit separation of the side walls thereof to a spaced apart distance enabling positioning of the pivot pins within the corresponding bosses of the mounting brackets.

BRIEF DESCRIPTION OF THE DRAWINGS

In order that the invention may be more fully comprehended it will now be described, by way of example, with reference to the accompanying drawings in which:

FIG. 1 is a perspective view of an infant's seat with the sun shield assembly of the invention attached thereto;

FIG. 2 is an end view of the infant's seat and sun shield assembly of FIG. 1, partly in cross-section, taken along line 2—2 thereof;

FIG. 3 is an exploded fragmentary view of a portion of the hood side wall and pivot pin carried thereon and of the mounting bracket showing also a preferred reinforcing of the side wall; and FIG. 4 is a view similar to FIG. 3 showing an alternate construction for the pivot pin and mounting bracket.

DETAILED DESCRIPTION OF THE INVENTION

Referring to the drawings there is shown a sun shield 10 constructed in accordance with the invention and attached to an infant's seat 12. It will be observed that the sun shield is secured by means of a pair of mounting brackets 14 to the respective side walls 16 of the infant's seat.

The sun shield comprises a hood 18 having a top wall 20 and depending side walls 22. Desirably the hood is configured in the general form of a semi-sphere having an open front portion 24. The hood, and preferably also the mounting brackets, are made of a synthetic plastics material. This serves to facilitate manufacture of the sun shield assembly and also provides the hood with the desired degree of resiliency, particularly in the area of the side walls. The hood should possess sufficient flexibility such that the side walls can be spread apart a distance which will enable the side walls to have the pivot pins 26 thereof to snap into the bosses 28 of the mounting brackets. Normally the side walls of the hood are spaced apart a distance less than that required to position the pivot pins in the bosses of the mounting brackets.

The mounting brackets each comprise a base portion 30 and a hollow cylindrical boss 28 projecting therefrom. The base portion is desirably in the form of a disc having one face 32 thereof provided with an adhesive material 34 which permits the releasable securing of the mounting bracket to the side wall of the infant's seat. There are a number of adhesives commercially available at this time which can be employed. The cylindrical boss 28 projects from the opposed face of the base portion and is hollow so as to accept the corresponding pivot pine 26 on the hood side wall. A preferred construction for the boss is depicted in FIG. 4 where at least one axial slot 36 is formed in each boss open at the outer extremity 38 and angularly displaced at its inner terminus 40 to permit the locking of a radial locking pin 41 carried by the pivot pin in the angularly displaced portion 42 to thereby maintain the hood of the sun shield in a predetermined angular disposition relative to the side wall of the infant's seat. By virtue of the adhesive face on the mounting bracket the brackets can be mounted at any desired location along the side wall of the infant's seat and can be readily detached therefrom when so desired.

Secured fixedly to the lower portion of each of the side walls of the hood is a cylindrical pivot pin 26. When the hood is formed of a synthetic plastics material and is molded therefrom, as is contemplated in its preferred form, the pivot pins are formed integrally with the hood and project laterally from the side walls.

It is also preferred that the side wall portions of the hood be provided with a reinforcing web 44 which extends upwardly from the region of the pivot pin. This serves to impart the desired rigidity to the side walls while not interfering with the resiliency described above.

From the foregoing it will be seen that a simply constructed sun shield assembly has been provided comprising a hood having pivot pins integral therewith and a pair of mounting brackets which can be releasably secured at the desired location to the side walls of an infant's seat and is dimensioned and configured to releasably receive the pivot pins of the hood for the mounting of the hood thereon in the desired angular disposition relative to the infant's seat.

We claim:

1. A sun shield assembly for detachable attachment to a selected location on an infant's seat comprising in combination:

a pair of mounting brackets each having a base portion and a hollow cylindrical boss projecting from one face of said base portion, an adhesive material being provided on the opposed face of said base portion for releasably securing the bracket to a selected region on the outer side wall of an infant's seat;

a hood having a top wall and opposed side walls, a pivot pin integral with each of said side walls and projecting laterally therefrom inwardly and having a configuration complementary to that of the corresponding boss of the mounting bracket and dimensioned to be accommodated rotatably within said bosses, said hood being sufficiently resilient to permit separation of the side walls thereof to a spaced apart distance enabling positioning of said pivot pins within the corresponding bosses of the mounting brackets;

and means on said pivot pins and mounting brackets cooperable with each other to maintain the sun shield in a predetermined angular disposition relative to the infant's seat.

2. A sun shield assembly according to claim 1, wherein a radial locking pin is carried by each of said pivot pins and at least one axial slot is formed in the side wall of each of said bosses, said axial slots being open at their outer extremities and angularly displaced at their inner extremities to thereby be adapted to retain the locking pin of the corresponding pivot pin therein and maintain the sun shield in a predetermined angular disposition relative to an infant's seat.

3. A sun shield assembly according to claim 1, wherein said hood and mounting brackets are made of a synthetic plastics material.

4. A sun shield assembly according to claim 1, wherein each of said hood side walls is provided with a reinforcing web extending upwardly from the region of the pivot pin therein.

* * * * *